United States Patent [19]

Benin et al.

[11] 4,428,539

[45] Jan. 31, 1984

[54] APPARATUS TO ASSIST DOFFING OF A YARN WINDUP

[75] Inventors: Joshua Benin, Newark; Kenneth L. Mulholland, Wilmington, both of Del.; John F. Reichenberg, Salisbury, Md.

[73] Assignee: E. I. Du Pont de Nemours and Company, Wilmington, Del.

[21] Appl. No.: 485,751

[22] Filed: Apr. 18, 1983

Related U.S. Application Data

[63] Continuation of Ser. No. 277,141, Jun. 25, 1981, abandoned.

[51] Int. Cl.[3] ..... B65H 54/06; B65H 67/04

[52] U.S. Cl. ..... 242/18 A

[58] Field of Search ..... 242/18 A, 18 PW, 25 A

[56] References Cited

U.S. PATENT DOCUMENTS

| | | | |
|---|---|---|---|
| 2,778,578 | 1/1957 | Keith | 242/18 DD |
| 3,310,247 | 3/1967 | Emery | 242/18 PW |
| 3,311,311 | 3/1967 | Furst | 242/18 DD |
| 3,383,062 | 5/1968 | Meihofer et al. | 242/56 A |
| 3,507,453 | 4/1970 | Scragg et al. | 242/18 A |
| 3,550,871 | 12/1970 | Keith | 242/18 A |
| 3,921,923 | 11/1975 | Kuno et al. | 242/18 A |
| 3,941,321 | 3/1976 | Bosshard et al. | 242/18 A |
| 4,033,519 | 7/1977 | Abe et al. | 242/18 A |

*Primary Examiner*—Stanley N. Gilreath

[57] ABSTRACT

An auxiliary drive used in conjunction with a yarn winding apparatus at the doffing location to maintain bobbin chuck speed during doff has a selectively operable brake to stop both the drive and the chuck.

2 Claims, 3 Drawing Figures

APPARATUS TO ASSIST DOFFING OF A YARN WINDUP

This application is a continuation of application Ser. No. 277,141 filed June 25, 1981, now abandoned.

BACKGROUND OF THE INVENTION

This invention relates to a winding apparatus and more particularly to a doffing assist for a yarn windup.

Windups which include a print roll or drive roll to which yarn advances from a reciprocating traverse guide and from which yarn is deposited on a surface driven package are in wide use. To avoid waste during a doffing cycle such windups have been modified by the provision of two or more rotatable package supports alternatively movable into surface driven engagement with the drive roll and of auxiliary equipment for accomplishing the transfer of yarn from a full package to an empty driven support. Each package support is carried by a chuck or mandrel mounted near one end of a swing arm with the swing arms being pivotally mounted on a common rotatable disc or frame in such a manner that the package supports may be advanced in succession through donning, winding, and doffing positions while maintaining continuity of operation. However, these windups will not automatically doff yarns consistently that have low retraction. To automatically doff such yarns the threadline tension must be maintained.

SUMMARY OF THE INVENTION

To maintain the threadline tension in the yarn package being doffed, the fallen package is driven by a yieldably mounted rubber covered drive roll located at the doffing position that engages the bobbin chuck and rotates the wound bobbin at a predetermined surface speed at least equal to the speed at which the yarn is being supplied to the windup. There are means provided to selectively rotate and stop the rubber covered drive roll.

DETAILED DESCRIPTION OF THE ILLUSTRATED EMBODIMENT

Figure 1:
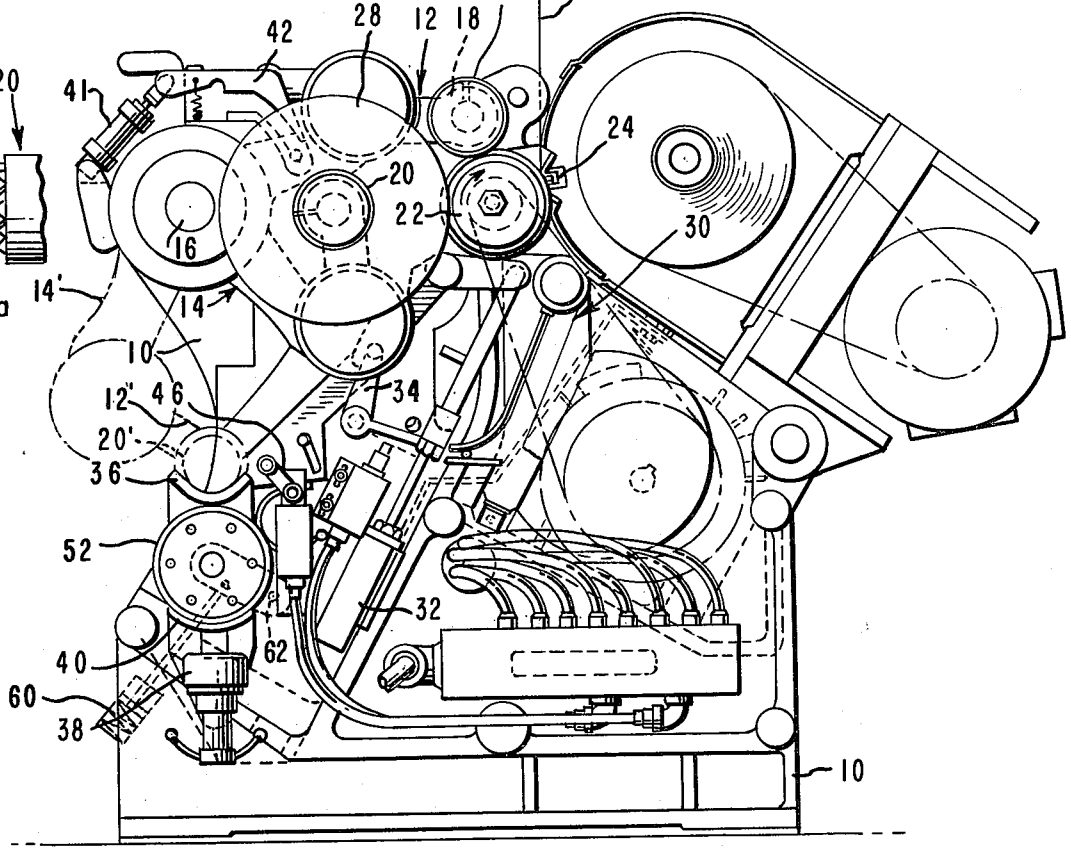
FIG. 1 is a side elevation view of a windup into which the auxiliary drive of the present invention has been incorporated.
Figure 2:
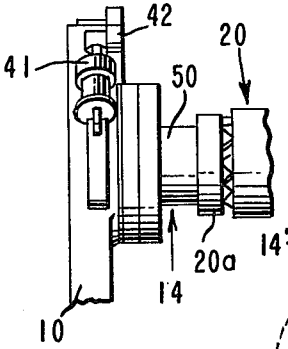
FIG. 2 is a fragmentary view of the windup.

Referring to FIGS. 1 and 2, it will be seen that the windup chosen for purposes of illustration is similar to that disclosed in U.S. Pat. No. 3,310,247 by Emery and includes generally, as components thereof, an equipment frame 10, a pair of articulated swing arms 12, 14 mounted for relative rotation about a common pivot 16, rotatable chucks 18, 20 on stub shafts at the extremities of arms 12, 14, a drive roll 22, a reciprocating traverse guide 24 through which yarn 26 advances over drive roll 22 to a package 28 on chuck 20 and a transfer mechanism 30.

Figure 3:
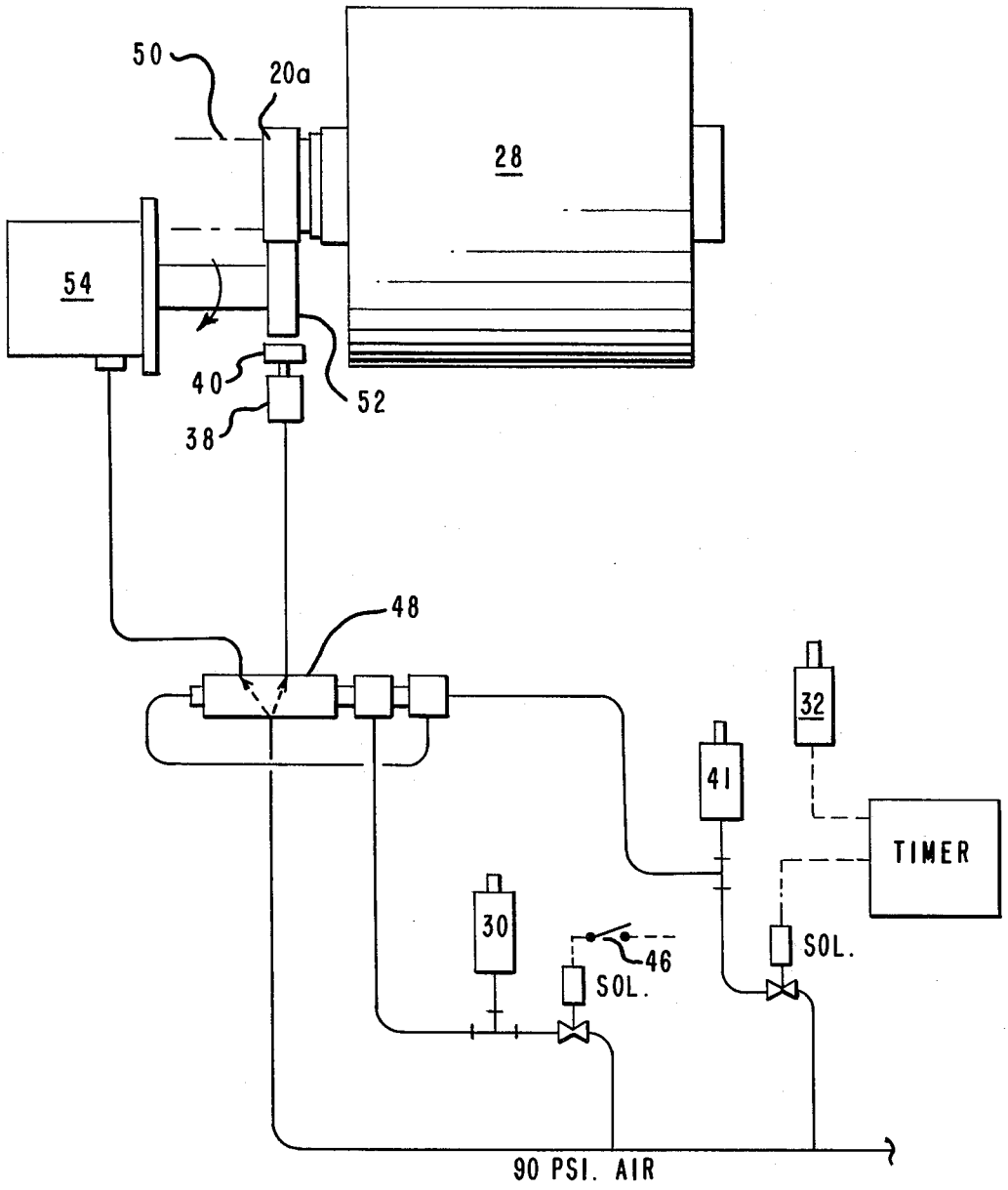
FIG. 3 is a schematic view of the drive and braking means of the present invention.

At the timed completion of package 28, a piston and cylinder assembly 41 is actuated to pivot a latch 42 clockwise thereby releasing arm 12 from its ready position to one in which an empty support tube 44 on chuck 18 is in surface driven engagement with drive roll 22. At the same time an air signal displaces four-way valve 48 (FIG. 3) supplying pressurized air to the air motor 54 which then rotates wheel 52. Simultaneously a piston and cylinder assembly 38 is actuated to withdraw a brake shoe 40 from contact with rubber covered drive wheel 52. After a 5 to 20 second delay for acceleration of support tube 44 and drive wheel 52 a piston cylinder assembly 32 and coupled linkages are actuated to release pawl 34 to prepare the illustrated cams for the descent of arms 12 and 14 to a point where the chuck braking surface 20*a* engages wheel 52, deflecting it (and air motor 54) around pivot 62 against the urging of shock absorber 60; the chuck and swing arm 12 continue to descend until the latter rests on fixed cradle 36 at position 20'. The yieldable mounting (pivot 62 and shock absorber 60) for the air motor and wheel 52 is important because with a rigidly mounted drive the arms 12 and the chuck and yarn package on falling were subject to severe bouncing off the wheel 52 resulting in a loss of yarn package drive; in some cases as little as 0.1 second loss of drive resulted in slack yarn and failure to transfer from a full package to an empty support. The yieldable mounting essentially eliminates this loss of drive.

The descent of package 28 and arms 12, 14 trips a switch 46 to initiate pivotal movement of mechanism 30 to a level position beneath drive roll 22 and the then driven but empty package support 44 on chuck 18. The package 28 descends so that the swing arm 12 rests in fixed cradle 36 and chuck braking surface 20*a* is in surface driven engagement with wheel 52 and the chuck 20 continues to rotate so that the package surface speed is at least equal to yarn speed until the transfer mechanism 30 has transferred yarn 26 to the support on chuck 18. The transfer mechanism 30 then retracts and sends an air signal to the four-way valve 48 which diverts air from the motor 54 to the brake cylinder 38 and brake shoe 40 rises into engagement with wheel 52. This stops package 28 from rotating and leaves it ready for doffing.

With respect to the speed of the wheel 52, it should be recognized that the size of the yarn package (if any) is indeterminate at the time the braking surface 20*a* engages wheel 52 therefore, before engagement, the air motor 54 must be driving the wheel 52 at a sufficiently high speed to later result in a yarn package surface speed at least equal to yarn line speed. Thus, the initial or no-load speed of wheel 52 is determined by the size of the smallest package to be driven and this size is assumed to be a practically empty bobbin giving a high wheel speed. For packages larger than the minimum the speed of the wheel 52 will therefore be greater than required for a match-up with yarn speed; thus, when the drive surface 20*a* encounters the wheel 52 some slippage will occur, however, the wheel and the air motor decelerate, quickly reaching "synchronous" speed with the drive surface 20*a*. This has a beneficial effect since some of the rotational energy of the decelerating drive wheel is imparted to the chuck and package thereby maintaining or even slightly increasing yarn package surface speed, to maintain yarn tension at the time of transfer.

It is apparent that many changes and modifications may be made without departing from the spirit of the present invention which is intended, accordingly, limited only by the scope of the appended claims.

We claim:

1. In a yarn winding apparatus that includes a frame, a drive roll for winding yarn on a bobbin by driven engagement with the bobbin, a plurality of articulated swing arms each carrying a bobbin chuck for rotatably mounting a yarn bobbin, said arms in turn being mounted to said frame for movement between an operative position where the yarn bobbin rests on the drive roll to wind yarn on the bobbin and an inoperative position where the wound bobbin moves away from the drive roll to a doffing position, the improvement comprising: a drive wheel pivotally mounted to said frame and located at said doffing position to engage said bobbin chuck and rotate the wound bobbin at a predetermined speed; a shock absorber connected between said drive wheel and said frame for maintaining said drive wheel at said doffing position for engagement with said bobbin chuck as said bobbin chuck is moved to said doffing position, whereby said drive wheel is yieldably mounted to said frame and said yieldable mounting prevents bouncing off of the bobbin chuck and drive wheel; and means selectively operable to rotate and stop said drive wheel.

2. The apparatus as defined in claim 1, said means to rotate and stop said wheel comprising: a rubber covering on said wheel engaging the bobbin chuck, and a brake shoe located to selectively release and engage the rubber covered wheel.

* * * * *